United States Patent [19]

Frei et al.

[11] Patent Number: 4,588,605

[45] Date of Patent: May 13, 1986

[54] METHOD OF AND ARRANGEMENT FOR APPLYING A STRIP-SHAPED POWDER LAYER ON A WELD SEAM OF CONTAINERS, AND A CONTAINER

[75] Inventors: Siegfried Frei, St. Gallen; Ernst Hohl, Wittenbach, both of Switzerland

[73] Assignee: Siegfried Frei, Gallen, Switzerland

[21] Appl. No.: 589,346

[22] Filed: Mar. 14, 1984

[30] Foreign Application Priority Data

Mar. 21, 1983 [CH] Switzerland ..... 1537/83

[51] Int. Cl.[4] ..... B05D 1/06

[52] U.S. Cl. ..... 427/28; 427/33; 427/181

[58] Field of Search ..... 427/27, 28, 29, 32, 427/33, 181

[56] References Cited

U.S. PATENT DOCUMENTS

| | | | |
|---|---|---|---|
| 3,248,253 | 4/1966 | Barford | 427/25 |
| 4,205,621 | 6/1980 | Payne | 118/622 |
| 4,212,266 | 7/1980 | Payne | 118/712 |
| 4,215,648 | 8/1980 | Stamets et al. | 427/28 |

FOREIGN PATENT DOCUMENTS 2028171 3/1980 United Kingdom .

*Primary Examiner*—Richard Bueker

*Attorney, Agent, or Firm*—Werner W. Kleeman

[57] ABSTRACT

A strip-shaped powder layer is applied onto a weld seam of a container so that powder/gas mixture is supplied into a chamber having a lower pressure than in the surrounding atmosphere, is statically charged there, and partially applied onto the seam.

8 Claims, 6 Drawing Figures

Fig. 1
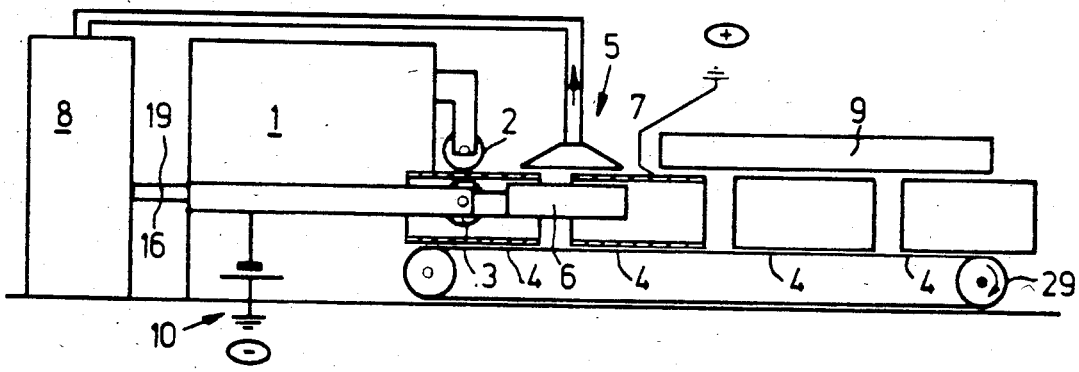
Fig. 2
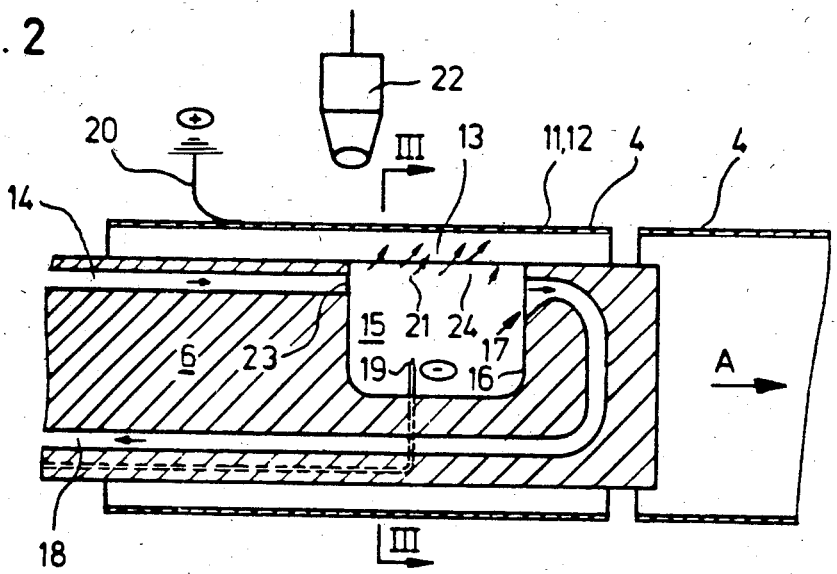
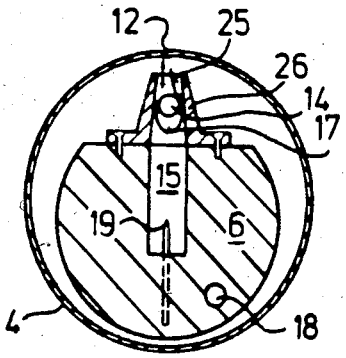
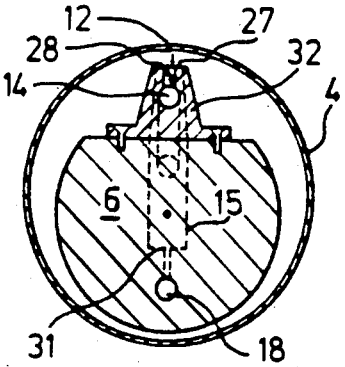
Fig. 3
Fig. 6

METHOD OF AND ARRANGEMENT FOR APPLYING A STRIP-SHAPED POWDER LAYER ON A WELD SEAM OF CONTAINERS, AND A CONTAINER

The present invention relates to a method of and arrangement for applying a strip-shaped powder layer on a weld seam of a can body, such as food cans and the like, and a can body with a weld seam covered by a powder layer applied thereby. Reference is made to our copending application Ser. No. 478,279, filed Mar. 24, 1983.

Methods and arrangement of the above-mentioned general type are known in the art. The Swiss Pat. No. 603,249 discloses a powder coating arrangement in which a stream of powder/air mixture is brought into a chamber which is open toward the weld seam and braked in the chamber by inserts located traverse to the direction of the stream, distributed and deflected to the outlet opening. The powder particles which forcedly adhere to the deflecting plates must be removed with an additional stream from the spray chamber and blown to the weld seam. In the sense of flow technique the arrangement has many deficiencies and thereby it possesses a high consumption of a transport- and suction air, as well as reprocessed powder. With failing of one container, the whole powder cloud must be aspirated through a suction hood provided above the arrangement.

Another powder applying arrangement is disclosed in the U.S. Pat. No. 4,215,648. In this arrangement powder is separated from the carrier gas by centrifugal separation and supplied in a tight stream at an acute angle to a spot to be coated. The powder stream is blown to the weld seam with an air cushion, for example through a porous wall of the spray chamber. In the arrangement the whole quantity of powder which has not adhered to the weld seam must be aspirated between the successive containers by outward suction. Then the powder particles are pulled because of the negative pressure formed there, inwardly of the container in all regions which communicate with the surrounding and deposit at locations which need not be coated, for example on the outer side of the container. In addition to a great consumption of powder and energy for pressure- and suction air, it is impossible to provide a small coating extending along the weld seam and having a constant thickness, since there is no possibility of dosing the powder quantity to be applied.

U.S. Pat. Nos. 4,212,266 and 4,205,621 disclose a powder applying arrangement in which the air stream supplied parallel to a powder supply conduit blows the powder from the arrangement upwardly onto the weld seam. Return of the particles which have moved upwardly but not adhered to the weld seam is performed by a collector located in the rear part (downstream) of the arrangement. The collector or catcher communicates via a slot under the wall opposite to the supply and air conduits, with the arrangement.

SUMMARY OF THE INVENTION

Accordingly, it is an object of the present invention to eliminate the disadvantages of the known methods and arrangements of the above-mentioned type.

In particular, it is an object of the present invention to save material and energy during operation.

In keeping with these objects and with others which will become apparent hereinafter, one feature of the present invention resides, briefly stated, in a method and an arrangement in accordance with which in a spray chamber of a spray head into which a powder is supplied, a pressure which is lower than a pressure in the surrounding atmosphere is provided.

The provision of a lower pressure in the spray chamber and the continuous aspiration of the supplied powder inside the spray chamber prevents discharging the powder particles into the surrounding atmosphere both during the coating process, and in the absence of one or several containers in the application region.

The absence in the arrangement of guiding, distributing and deflecting means which conventionally cause powder deposits allows the provision of the arrangement without means for eliminating the same. In the event of production interruptions, discharge of powder from the spray head can be momentarily interrupted by turning off the voltage of the electrodes, without interrupting the powder flow. The powder circulating in the spray head can be supplied back into the spray head from the processing device uncleaned, since there is no possibility of dirting the same. It is to be understood that only small reprocessing device suffices for a small quantity of powder particles extending through the distances between the successive containers and caught by the outer suction.

Because of the direct dependency of the powder quantity separated from the powder stream onto the weld seam, from the height or amplitude of the voltage on the electrodes, the application thickness of the powder on the seam can be each time adjusted from outside, or boundary conditions such as air moisture, distance of the seam from the powder stream etc can be compensated. Because of the lower pressure in the spray opening relative to the surrounding, unavoidable up to now lateral limiting brushes along the opening can be dispensed with in the arrangement.

The invention will be best understood from the following description of preferred embodiments, which is accompanied by the following drawings.

BRIEF DESCRIPTION OF THE DRAWINGS

FIG. 1 is a view schematically showing a powder applying arrangement on a welding machine for welding a longitudinal seam of containers;

FIG. 2 is a view showing a vertical section through a spray head of the applying arrangement in accordance with the present invention;

FIG. 3 is a view showing a section of the spray head, taken along the line III—III in FIG. 2;

FIG. 6 is a view showing a section taken along the line VI—VI in FIG. 5.

DESCRIPTION OF PREFERRED EMBODIMENTS

Figure 4:
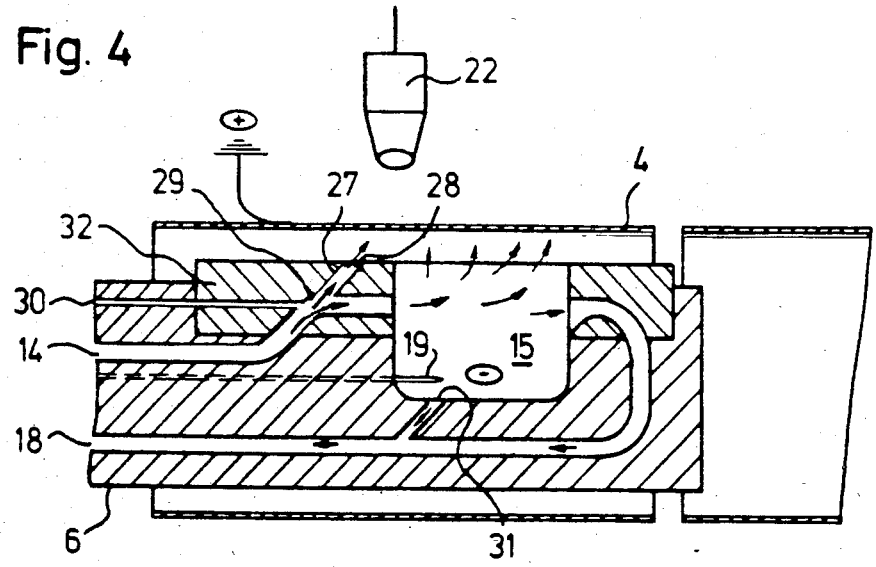
FIG. 4 is a view showing a longitudinal vertical section of the spray head in accordance with another embodiment of the present invention.

Processing, reprocessing and melting of a powder in a homogenous layer on a seam are not the objects of the present invention and are described only to the extent necessary for understanding the invention.

FIG. 1 schematically shows a known seam-welding machine 1 with electrode rollers 2 and 3, individual newly welded containers 4, a powder application arrangement 5 with a spray head 6, an outer suction 7 and a combined processing- and reprocessing device 8, as well as a known heating device 9 for melting the powder on the seam. An electrical device for production of high voltage for charging the powder is shown symbolically and identified with reference numeral 10. It is to be understood that instead of the welding machine with roller electrodes, a machine with an energy jet welding head, for example a laser can be used.

The powder spray head 6 is shown in FIG. 2 on an enlarged scale in a longitudinal section.

A container or can body 4 is also shown over the spray head 6. It passes the spray head 6 from the left side to the right side in accordance with the arrow A. An upper cutting surface 11 through the container 4 runs exactly in a weld seam 12 of the container 4 and lies above a spray opening 13.

A supply conduit 14 opens substantially parallel to the weld seam 12 in a slot-shaped recess or spray chamber 15 in the spray head 6. An opening 17 of a conduit 18 is located in a rectilinear extension of the conduit 14 in the opposite wall of the recess 15. The conduit 18 communicates with a vacuum generator in the processing device 8. Advantageously the opening 17 is formed funnel-shaped. A needle-shaped electrode 19 extends in the lower region of the recess 15. It is connected with the adjustable high voltage source 10 which is not shown in FIG. 2. A sliding contact 20 touches the container 4 which moves directly over the spray head 6, and provides on the container 4 a voltage which is opposite to that of the electrode 19. It has been recognized as favorable when the container is connected with a positive pole, whereas powder particles 21 supplied in a carrier gas through the conduit 14 into the recess 15 are charged via the electrodes 19 negatively. A sensor 22 is arranged outside the spray head 6 to monitor the presence of the container or can body 4 in the region of the recess 15.

The powder particles 21 transported in the supply conduit 14 by the carrier gas are discharged from a mouth or outlet opening 23 of the conduit 14 in the form of a bundled jet 24 and flow directly in the direction of the opening 17 in the opposite wall 16 from which it is supplied back by the suction action to the processing device 8. The vacuum source is formed so that at least the whole carrier gas quantity as well as the powder particles 21 contained therein, which are supplied through the supply conduit 14 to the spray chamber or recess 15, are aspirated again through the conduit 18. As a result, the particles 21 neither abandon the recess 15, nor return back to it.

When the sensor 22 first detects the presence of a container 4, the needle-shaped electrode 19 or several electrodes are connected with the negative pole of the high voltage source 10. The powder particles which traverse the recess 15 as the bundled jet 24 extending in a substantially rectilinear natural path are statically charged. A part of these particles 21, which have a negative charge, are pulled by the container 4 having a positive charge and remain adhering on the latter. Depending upon the magnitude of the voltage on the electrode 19, more or less particles are transferred onto the container 4.

In the event of absence of the container or can body or a distance between two successive containers 4 which is greater than a predetermined value, the voltage on the electrode 19 is interrupted by the sensor 22. The powder particles which are continuously supplied from the supply conduit 14 are then aspirated as a whole by the suction conduit 18 and transported to the processing device 8.

For obtaining a laterally sharply limited powder strip which covers only the region of the weld seam and the immediately adjacent portion, the spray head 6 is provided with guide plates 25 which deflect the particles 21 flowing to the container or can body 4 toward the weld seam region 12, as can be seen from FIG. 3. Advantageously, the guide plates 25 are a part of an exchangeable adapter 26 which can be placed on the spray head 4 through the opening 15. Since the recess or spray chamber 15 is under a permanent negative pressure, the particles 21 flowing to the container 4 tend to deposit in the central region of the seam 12. Thereby lateral sealing members, such as for example brushes, are superfluous.

In accordance with a further embodiment of the invention shown in FIGS. 2 and 3, the spray head 6 of FIG. 4 has a spray nozzle 27 defining a spraying opening located prior to the spray region of the recess 15. A fine powder stream 28 can discharge exactly onto the weld seam 12 from the spray nozzle 27. The powder discharged from the nozzle 27 is not loaded. A small loading can be provided within some limits by friction of the powder particles 21 in the conduit 14. The adherence of the powder particles 21 on the weld seam 12 is provided either by arranging the spray head 6 directly at the outlet on the weld seam 12, or by maintaining the weld seam hot so that sticking of the particles 21 on the seam 12 takes place.

The spray nozzle 27 can be connected directly with the supply conduit 14, whereas the connection can be made in an arcuate portion 29 of the conduit 14. For interruption of the powder stream 28, a further conduit 30 is provided and opens into the arcuate portion 29. The conduit 30 can deflect by a fine air jet the particles 21 in the absence of a container or can body 4 through the conduit 14 toward the recess 15.

The powder particles 21 thrown by the spray nozzle 27 on the weld seam and not adhering to the seam are aspirated into the recess or spray chamber 15 because of the low pressure in the latter and transported by suction through the conduit 18 to the processing device 8. For preventing accumulation of the particles 21 falling on the bottom of the recess 15, especially when additional air is blown through the conduit 30, a further suction opening 31 can be provided in the recess 15.

Figure 5:
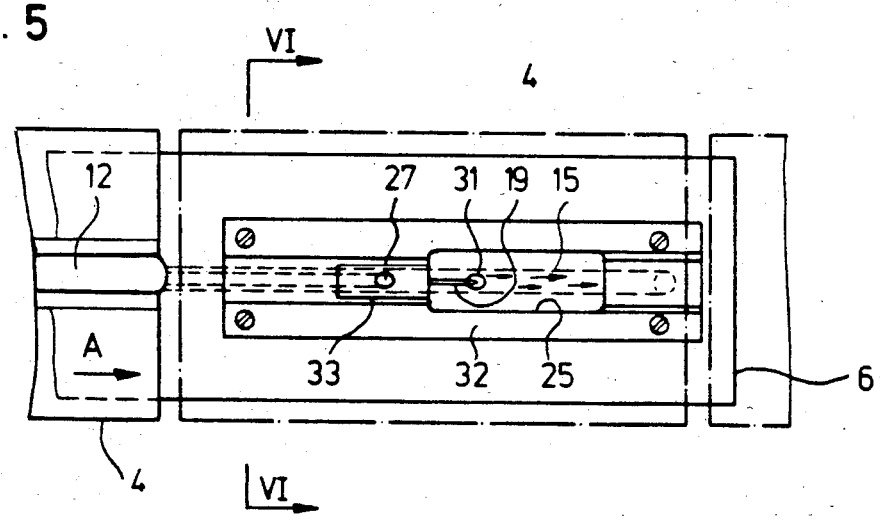
FIG. 5 is a plan view of the spray head shown in FIG. 4.

FIG. 5 shows the embodiment of FIG. 4 from above. The distance between the guide plates 25 substantially corresponds to the width of the powder strip to be produced on the container or can body 4. The width of the spray nozzle or spray opening 27 substantially corresponds to the width of the seam. It can be formed round or as a slot lying parallel to the weld seam 12. The spray nozzle or spray opening 27 can either directly open on the weld seam 12, or it can lie at the bottom of a slot 33 leading to the opening 13. Particles which have not adhered to the seam 12 travel through the slot 33 to the recess or spray chamber 15 and from there into the suction conduit 18.

The guide plates 25 and the slot 33 can be a part of an adapter 32 which can be fitted onto the spray head 6. The spray head 6, provided with a respective adapter 32, can be used for different application types and widths.

In a section in accordance with FIG. 6, a part of the powder particles 21 leave the supply conduit 14 at the bottom of the slot 33. The lateral guidance which prevents dissipation of the particles 21 near the seam 12 can be clearly seen here.

In the above-described examples the conveyor device for the powder particles 21 is the same as the transport device of the containers or can bodies 4. It is to be understood that the containers 4 can be transported in the opposite direction to the spray head 6.

The invention is not limited to the details shown since various modifications and structural changes are possible without departing in any way from the spirit of the present invention.

What is desired to be protected by Letters Patent is set forth in particular in the appended claims.

I claim:

1. A method of forming and applying a substantially strip-shaped powder layer onto a weld seam of a can body, comprising the steps of:

supplying a powder composed of powder particles transported by a carrier gas and in the form of a substantially bundled powder jet into a spray chamber of a spray head, wherein said spray chamber is open at a spray opening thereof towards the weld seam and is located opposite the weld seam;

establishing a pressure in the spray chamber which is lower than the pressure of the surrounding atmosphere to ensure retention of the bundled powder jet entering said spray chamber and to prevent formation of a spray cloud of the powder particles of said bundled powder jet composed of the powder transported by the carrier gas;

diverting at least part of the powder particles of the bundled powder jet from the spray chamber in the direction of the weld seam; and depositing said diverted powder particles onto the weld seam in the form of a substantially strip-shaped powder layer.

2. The method as defined in claim 1, further including the steps of:

aspirating the carrier gas from said spray chamber in a predetermined volume per unit time; and said supplying step including supplying into said spray chamber the carrier gas in a volume per time unit which is smaller than the volume per time unit of the carrier gas aspirated from said spray chamber.

3. The method as defined in claim 1, further including the steps of:

transporting the powder particles through said spray chamber in the form of said bundled powder jet which extends substantially parallel to the weld seam; and withdrawing powder particles which have not adhered to the weld seam from said spray chamber by suction.

4. The method as defined in claim 1, further including the steps of:

discharging the powder particles through an outlet opening of said spray chamber in the form of said bundled powder jet;

said step of diverting at least part of said powder particles of the bundled powder jet entailing electrostatically charging the powder particles of the powder when there is present a can body above said spray opening of said spray chamber so as to partially deflect the powder particles from said bundled powder jet in the direction of the weld seam of the can body; and withdrawing excess particles from the spray chamber by suction.

5. The method as defined in claim 4, wherein:

said electrostatically charging step includes adjustably charging the powder particles.

6. The method as defined in claim 4, further including the steps of:

providing a conduit having an opening and which is subjected to vacuum at a side of the spray chamber located opposite to said outlet opening of the bundled powder jet into the spray chamber and which conduit serves to establish said lower pressure in said spray chamber; and withdrawing the supplied bundled powder jet through said conduit which is under vacuum in the absence of a can body located above said spray opening of said spray chamber.

7. The method as defined in claim 6, wherein:

the step of withdrawing the supplied bundled powder jet through the conduit entails sucking essentially the entire bundled powder jet through an enlarged mouth defining said opening of the conduit in the absence of a can body located above said spray opening of said spray chamber.

8. The method as defined in claim 1, wherein:

said step of establishing said lower pressure in the spray chamber entails establishing a lower pressure in said spray chamber which is sufficient to prevent undesirable flow of the powder particles laterally from said strip-shaped powder layer deposited onto the weld seam, whereby there can be avoided the use of lateral limiting brushes along said spray opening of the spray chamber.

* * * * *